US010874195B2

(12) United States Patent
Omoto

(10) Patent No.: US 10,874,195 B2
(45) Date of Patent: Dec. 29, 2020

(54) METHOD FOR FORMING A FACIAL PAD

(71) Applicant: NICHIEI CO., LTD., Osaka (JP)

(72) Inventor: Susumu Omoto, Osaka (JP)

(73) Assignee: NICHIEI CO., LTD., Osaka (JP)

( * ) Notice: Subject to any disclaimer, the term of this patent is extended or adjusted under 35 U.S.C. 154(b) by 31 days.

(21) Appl. No.: 16/510,940

(22) Filed: Jul. 14, 2019

(65) Prior Publication Data

US 2019/0335881 A1 Nov. 7, 2019

Related U.S. Application Data

(62) Division of application No. 15/592,619, filed on May 11, 2017, now abandoned.

(51) Int. Cl.

| | |
|---|---|
| ***A45D 44/00*** | (2006.01) |
| ***A45D 37/00*** | (2006.01) |
| *A45D 40/00* | (2006.01) |
| *A45D 40/12* | (2006.01) |

(52) U.S. Cl.

CPC ..... *A45D 44/002* (2013.01); *A45D 37/00* (2013.01); *A45D 40/12* (2013.01); *A45D 2040/0062* (2013.01); *A45D 2200/1027* (2013.01); *A45D 2200/1036* (2013.01)

(58) Field of Classification Search

CPC ..... A45D 44/002; A45D 2200/1027; A45D 2200/1036; A45D 37/00

See application file for complete search history.

(56) References Cited

U.S. PATENT DOCUMENTS

| | | | | |
|---|---|---|---|---|
| 5,417,674 | A | 5/1995 | Smith | |
| 9,884,717 | B2 * | 2/2018 | Tsujimura | A61F 13/0276 |
| 2014/0352031 | A1 * | 12/2014 | Choi | A42B 1/04 2/173 |
| 2015/0063895 | A1 | 3/2015 | Dobler | |

FOREIGN PATENT DOCUMENTS

| | | | | |
|---|---|---|---|---|
| CN | 104146879 | A | 11/2014 | |
| EP | 3066953 | A1 * | 9/2016 | A45D 44/002 |
| JP | 11-137338 | A | 5/1999 | |
| JP | 2001-089352 | A | 4/2001 | |

(Continued)

OTHER PUBLICATIONS

Pending Claims from Parent U.S. Appl. No. 15/592,619, filed May 11, 2017.

(Continued)

*Primary Examiner* — Jennifer C Chiang

(74) *Attorney, Agent, or Firm* — Renner, Otto, Boisselle & Sklar, LLP

(57) ABSTRACT

A method for forming a facial pad, the method including: (a) forming a water-impermeable film on one surface of a first sheet body that is flexible and elastic; (b) forming a water-impermeable film on one surface of a second sheet body that is flexible and elastic; (c) applying a creamed or gelled beauty material on a surface of the film formed in step (a); (d) after step (c), stacking the first sheet body and the second sheet body so as to sandwich the beauty material between the films formed in steps (a) and (b); and (e) cutting the first sheet body and the second sheet body which sandwich the beauty material in step (d) into a predetermined shape.

3 Claims, 5 Drawing Sheets

(56) References Cited

FOREIGN PATENT DOCUMENTS

| | | | |
|---|---|---|---|
| JP | 2002-172022 | A | 6/2002 |
| JP | 2003-000336 | A | 1/2003 |
| JP | 2004209074 | A | 7/2004 |
| JP | 2006-14857 | A | 1/2006 |
| JP | 2010069287 | A | 4/2010 |
| JP | 2012-51847 | A | 3/2012 |
| JP | 2013-132398 | A | 7/2013 |
| WO | 2017/111233 | A1 | 10/2007 |

OTHER PUBLICATIONS

Office Action dated Apr. 18, 2019 for Parent U.S. Appl. No. 15/592,619, filed May 11, 2017.

* cited by examiner

METHOD FOR FORMING A FACIAL PAD

BACKGROUND OF THE INVENTION

1. Field of the Invention

The present invention relates to a facial pad that is placed on human face for use when supplying a beauty material to facial skin.

2. Description of Related Art

Conventionally, facial masks which are cosmetic sheet bodies have been used as beauty articles for use when supplying creamed or gelled beauty materials to facial skins (for example, see JP 2002-172022 A1). The facial mask consists of a sheet body that has cuts or hole portions at sections corresponding to eyes, nose and mouth and is impregnated or coated with a beauty material; and when used, it is placed on human face.

Further, among conventional facial masks, there are small-sized facial pads having specific shapes, for example, so as to be placed on a part under the eye or the like, in order to supply the beauty material only to a part of the face such as outer corner of the eye and/or cheek.

Human face is of generally bilateral symmetry in shape, so that in many cases a set of small-sized facial pads consists of a pair of sheet bodies.

However, conventional small-sized facial pads have been produced by applying the creamed, gelled or liquid beauty material onto one side that each of the two sheet bodies (made of nonwoven fabric for example) has, and then sticking a releasing paper or releasing film to each beauty material. Therefore, on usage, it has been necessary to remove the releasing paper or releasing film from each of the two sheet bodies, which not only makes the task on usage troublesome, but also makes the beauty material adhering to the releasing paper or releasing film that is removed from each of the sheet bodies useless. Moreover, because the sheet body is made of a nonwoven fabric with flexibility and elasticity so as to conform to unevenness of the face, the beauty material applied to one side of the sheet body penetrates into its interior; therefore, it is impossible to cause a sufficient amount of the beauty material to act on the facial skin.

SUMMARY OF THE INVENTION

A facial pad of the present invention retains a creamed or gelled beauty material between two films each borne by a sheet body with flexibility and elasticity. A facial pad of the present invention includes: two sheet bodies with flexibility and elasticity to one side of each of which a film is stuck; and a creamed or gelled beauty material that is retained between the two sheet bodies the respective one sides of which are caused to face each other.

According to the facial pad of the present invention, the creamed or gelled beauty material is retained between the two sheet bodies with being sandwiched by the films that are stuck to the two respective sheet bodies. The beauty material, being blocked by the film, never penetrates into the sheet body. Even when the two sheet bodies are separated, sum of the amount of beauty material applied to the respective films is equal to the total amount of the beauty material that had been retained between the two sheet bodies before they were separated. When each sheet body is placed onto the face, radiation of heat from the face is hindered by the film; and thus, temperature of the beauty material rises, thereby enhancing beauty effect.

In the facial pad of the present invention, the film may be a polyurethane film having a thickness of about 15 μm. This makes it easy to stick the film to the sheet body while preserving elasticity and flexibility of the sheet body. Also, application of the beauty material to the film becomes easier, since a surface roughness of polyurethane film is larger than that of polyethylene film.

DETAILED DESCRIPTION OF THE EMBODIMENTS

Figure 1:
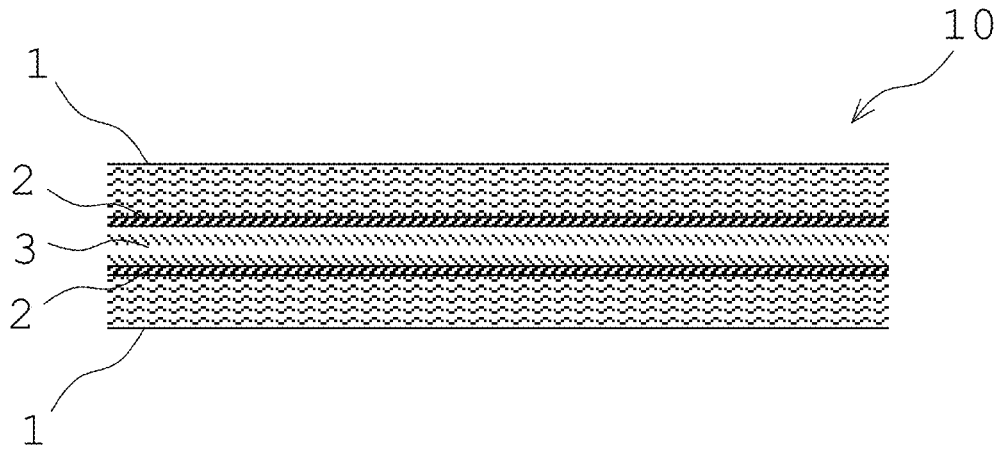
FIG. 1 is a cross-sectional view of a facial pad according to an embodiment of the present invention.

A facial pad according to an embodiment of the present invention is explained below, referring to the drawings. As shown in FIG. 1, a facial pad 10 according to an embodiment of the present invention is formed of a creamed or gelled beauty material 3 sandwiched between two sheet bodies 1. The two sheet bodies 1 forming the facial pad 10 are each made to have a predetermined shape that is suitable for being placed on human face.

The two sheet bodies 1 are each formed of a sheet with elasticity and flexibility such as nonwoven fabric, an example of which is a nonwoven fabric made of elastic PET (polyethylene terephthalate) fiber. The nonwoven fabric made of elastic PET is elastic in longitudinal, lateral and diagonal directions, and has sufficient elasticity.

A film 2 with water-impermeable property is stuck to one side that each of the two sheet bodies 1 has, and is borne thereby. The film 2 is, as an example, a polyurethane film having a thickness of about 15 μm. For the film 2, a polyethylene film can be used; and the sheet body 1 can be prepared by applying molten polyethylene to one side of a sheet body 1 and thereafter drying. Because the polyurethane film having a thickness of about 15 μm is flexible, it has excellent adaptability to the deformation of the sheet body 1.

The creamed or gelled beauty material 3 has appropriate viscosity so as not to flow easily after being applied to the film 2. Preferably, the viscosity is ca. 30,000-100,000 cSt for example.

Figure 2A:
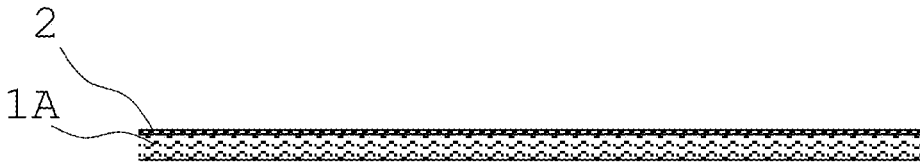
FIGS. 2A-2D are cross-sectional views showing a production process of the facial pad.
Figure 2B:
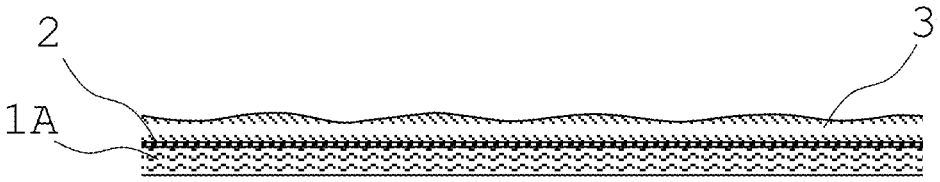

As shown in FIGS. 2A and 2B, a film 2 which is polyurethane film is stuck, using an adhesive, to an entire surface of one side of a sheet 1A an area of which is sufficiently larger than that of the sheet body 1 that has a predetermined shape suitable for being placed on the face; and then the beauty material 3 is applied to an upper surface of the film 2. The sheet 1A has a long length and is wound to a roll, and is pulled out from the roll when being using.

Figure 2C:
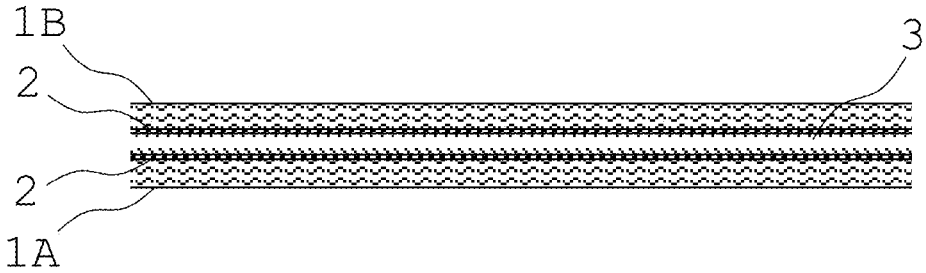

After that, as shown in FIG. 2C, another sheet 1B to one entire side of which a film 2 is stuck using the adhesive is laid on top of the sheet 1A in such a manner that the film 2 faces the beauty material 3 that has been applied to the upper surface of the film 2 of the sheet 1A. This causes the beauty material 3 to be sandwiched between the respective films 2 of the sheet 1A and the sheet 1B.

Figure 2D:
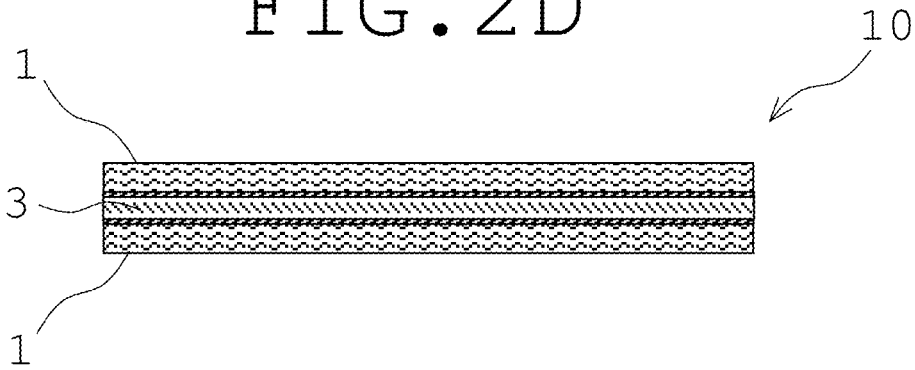

Further, as shown in FIG. 2D, a facial pad 10 is formed by cutting the predetermined shape of the sheet body 1 out of the sheet 1A and the sheet 1B that are in the state of sandwiching the beauty material 3 therebetween.

Since the facial pad 10 includes the beauty material 3 sandwiched between the respective films 2 of the two sheet bodies 1, it does not need any releasing paper or the like to prevent the beauty material 3 from adhering to other objects before use.

The two sheet bodies 1 retain the beauty material 3 therebetween with sides of the two sheet bodies 1 to each of which the film 2 is stuck being caused to face one another. Since the film 2 is water-impermeable, there is no possibility that the beauty material 3 penetrates into the sheet body 1.

Figure 3:
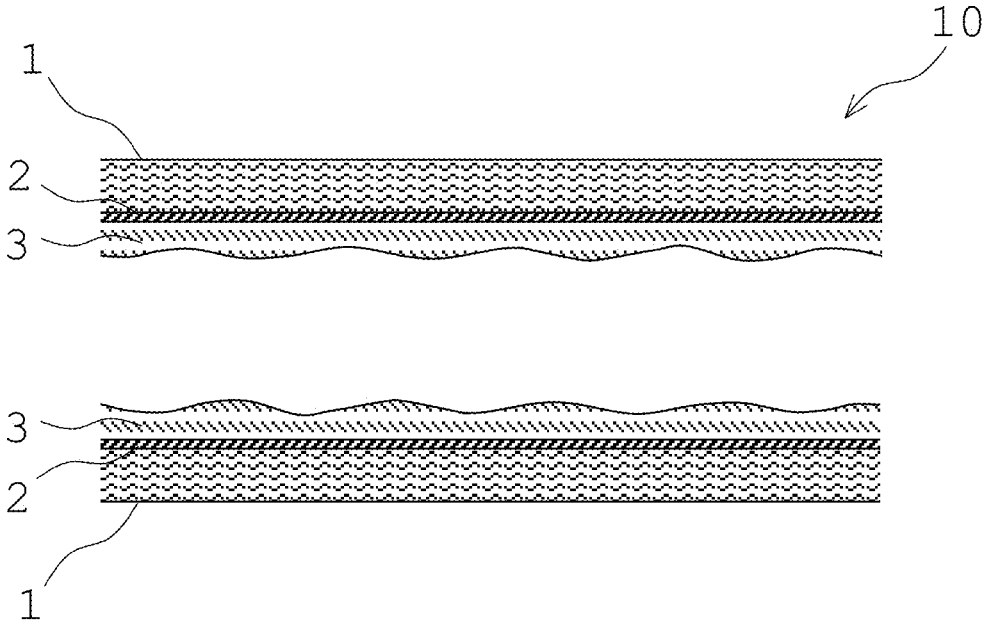
FIG. 3 is a cross-sectional view showing a state when the facial pad is separated.

Even when the two sheet bodies 1 are separated as shown in FIG. 3, sum of the amount of the beauty material 3 applied to the respective films 2 of the two sheet bodies 1 is equal to the total amount of the beauty material 3 that had been retained between the two sheet bodies 1 before they were separated. Preferably, the beauty material 3 is easy to be separated in two by adhesion to the films 2 when the two sheet bodies 1 being separated.

Figure 4:
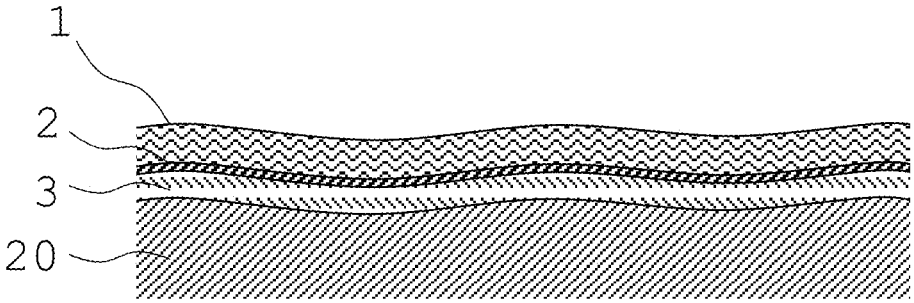
FIG. 4 is a cross-sectional view showing a state when the facial pad is used.

Therefore, as shown in FIG. 4, when the two sheet bodies 1 separated are placed on the face 20, the whole amount of the beauty material 3 that had been retained between the two sheet bodies 1 before they were separated can be caused to act on the face 20 without waste. Further, the sheet body 1 can deform easily conforming to the unevenness of the face 20, thereby making it possible to maintain to be stably placed on the face 20, since the sheet body 1 is formed of a nonwoven fabric of elastic PET and the film 2 that is stuck to one side thereof is polyurethane film having excellent adaptability. The beauty material 3 is easy to adhere to the films 2, since a surface roughness of polyurethane film is larger than that of polyethylene film. Therefore, the beauty material 3 is allowed to easily adhere to both of the films 2 when the two sheet bodies 1 being separated.

The facial pad 10 can also be produced by: cutting the sheet 1A to which the film 2 has been stuck into a predetermined shape to prepare two sheet bodies 1; then applying the beauty material 3 onto the film 2 of one sheet body 1; and thereafter, laying the other sheet body 1 on top of the one sheet body 1 in such a manner that the film 2 of the other sheet body 1 faces the beauty material 3 that has been applied to the one sheet body 1.

Also, because the film 2 shields the heat of the surface of the face 20 and thus hinders the radiation of heat, the beauty material 3 located between the face 20 and the film 2 is warmed by the heat of the face 20; therefore, through the thermal effect, beauty effect with the beauty material 3 can be enhanced.

Figure 5A:
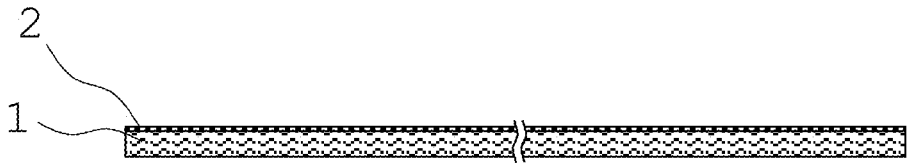
FIGS. 5A-5C are cross-sectional views of a facial pad according to another embodiment of the present invention.
Figure 5B:
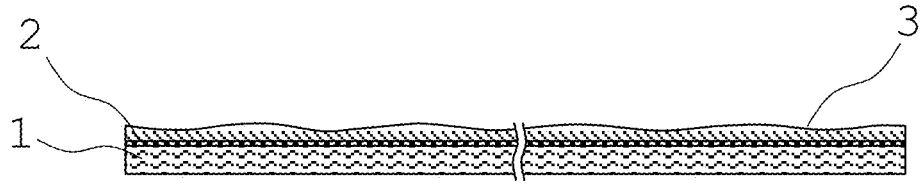
Figure 5C:
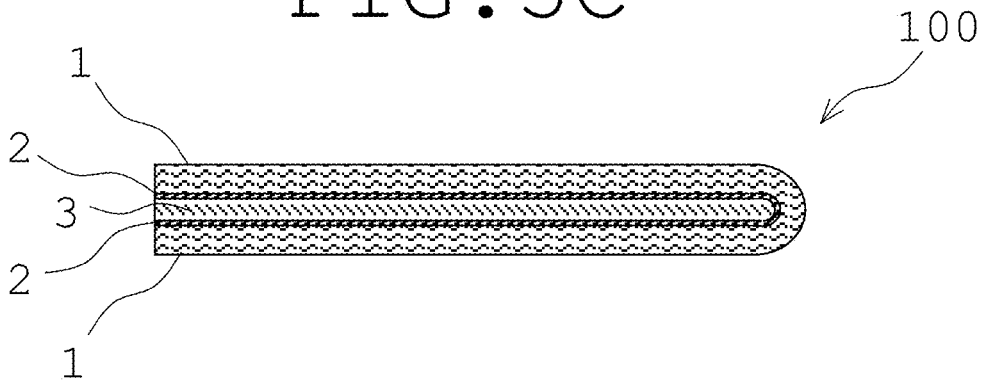

As shown in FIGS. 5A-5C, a facial pad 100 can also be formed, by sticking the film 2 to one side of one sheet body 1, then applying the beauty material 3 onto the upper surface of the film 2, and thereafter folding the sheet body 1 in two with the side to which the film 2 is stuck being caused to face inside.

When the facial pad 100 is used, unfolding the sheet body 1 that has been folded in two causes the beauty material 3 to be exposed in the state of being applied onto the upper surface of the film 2.

Further, planar shape of the sheet body 1 is not limited to a rectangular shape, but can have any shape depending on the shape of the face 20 on which the sheet body 1 is placed.

Above-mentioned embodiments are mere examples and not meant to limit the present invention, but various modifications to those can be made within the scope of the present invention.

What is claimed is:

1. A method for forming a facial pad, the method comprising:

(a) forming a water-impermeable film on one surface of a first sheet body that is flexible and elastic;

(b) forming a water-impermeable film on one surface of a second sheet body that is flexible and elastic;

(c) applying a creamed or gelled beauty material on a surface of the film formed in step (a);

(d) after step (c), stacking the first sheet body and the second sheet body so as to sandwich the beauty material between the films formed in steps (a) and (b); and (e) cutting the first sheet body and the second sheet body which sandwich the beauty material in step (d) into a predetermined shape.

2. The method according to claim 1, wherein, by using an adhesive, polyurethane films are stuck to the surfaces as the films in steps (a) and (b).

3. The method according to claim 1, wherein, by applying molten polyethylene to the surfaces and thereafter drying, polyethylene films are formed as the films in steps (a) and (b).

* * * * *